US005273273A

United States Patent [19]

Xydias

[11] Patent Number: 5,273,273

[45] Date of Patent: Dec. 28, 1993

[54] SHEET INVERTING MECHANISM HAVING DUAL DRIVE ASSEMBLIES

[75] Inventor: Jean Xydias, Pittsford, N.Y.

[73] Assignee: Eastman Kodak Company, Rochester, N.Y.

[21] Appl. No.: 982,550

[22] Filed: Nov. 27, 1992

[51] Int. Cl.[5] ..... B65H 29/00

[52] U.S. Cl. ..... 271/186; 271/225; 271/902

[58] Field of Search ..... 271/184–186, 271/225, 902

[56] References Cited

U.S. PATENT DOCUMENTS

| | | | |
|---|---|---|---|
| 4,487,506 | 12/1984 | Repp et al. . | |
| 4,737,820 | 4/1988 | Murray . | |
| 5,082,272 | 1/1992 | Xydias et al. | 271/186 |
| 5,131,649 | 7/1992 | Martin et al. | 271/302 |
| 5,183,249 | 2/1993 | Ichikawa | 271/186 |
| 5,201,517 | 4/1993 | Stemmle | 271/186 |
| 5,215,298 | 6/1993 | Stemmle et al. | 271/186 |

FOREIGN PATENT DOCUMENTS

| | | | |
|---|---|---|---|
| 212546 | 12/1993 | Japan | 271/186 |

*Primary Examiner*—Robert P. Olszewski
*Assistant Examiner*—Steven M. Reiss
*Attorney, Agent, or Firm*—Lawrence P. Kessler

[57] ABSTRACT

A sheet-inverting mechanism for use in a high-speed copier or printer includes a sheet containment chamber, a drive shaft rotatable in a forward direction, and a sheet-moving driven shaft assembly for moving sheets into and out of the chamber. The mechanism also includes a belt and pulley assembly mounted to one end of the drive shaft for selectively rotating the driven shaft assembly in a first forward direction for moving a sheet in that first direction into the chamber, and a meshing gear assembly mounted to the other end of the drive shaft for selectively rotating the driven shaft assembly in a second and reverse direction opposite to the first forward direction for quickly moving the sheet reversibly in that second direction and out of the chamber.

10 Claims, 5 Drawing Sheets

SHEET INVERTING MECHANISM HAVING DUAL DRIVE ASSEMBLIES

BACKGROUND OF THE INVENTION

1. Technical Field

This invention relates to sheet inverting mechanisms for use in sheet handling equipment, and more particularly to such a sheet mechanism that has dual drive assemblies for quickly reversing the direction of movement of a sheet in a sheet handling equipment such as a high-speed copier or printer.

2. Background Art

As disclosed, for example, in U.S. Pat. Nos. 4,847,506, issued Dec. 11, 1984 to Repp et al; U.S. Pat. No. 5,082,272, issued Jan. 21, 1992 to Xydias et al; and U.S. Pat. No. 5,131,649, issued Jul. 21, 1992 to Martin et al, sheet inverting mechanisms, such as J-turnover devices, are well known for use in electrostatographic copiers and printers. Such sheet inverting mechanisms are used to reverse the lead and trail edges, and hence the front-and-back face orientation of a sheet being handled in such a copier or printer.

Typically, each such sheet inverting mechanism includes a sheet containment chamber that has a first end with a sheet input nip for feeding sheets into the chamber and with an output nip for reversibly feeding sheets out of the chamber. The chamber also has a second end with a reversible sheet driving assembly for moving sheets within the chamber first in a forward direction and then reversibly in the opposite direction. As disclosed, for example in the U.S. Pat. No. 5,082,272 patent, such a reversible sheet driving assembly can be a passive spring, but as disclosed in the U.S. Pat. No. 4,487,506 patent, it can also be a reversible drive motor that is connected to sheet moving rollers by means of a pair of reversible meshing gears which rotate first in one direction, and then reversibly in an opposite direction.

Alternatively, the reversible sheet driving assembly can be a reversible roller drive assembly that is mounted on a movable support that shifts first to one side to drive sheet moving rollers in one direction, and then to a second and opposite side to drive the sheet moving rollers in an opposite direction. As can be expected in such conventional reversible sheet driving assemblies, motion in a first direction along with the attendant inertia of all moving components must first be brought to a complete stop before motion in a second and opposite direction can be started. This aspect of such assemblies can be a drawback.

In high-speed sheet handling equipment, and particularly in a sheet inverting mechanism for moving two sheets simultaneously as well as in opposite directions within the containment chamber, such conventional drive assemblies are slow, and are very likely to result in bottlenecks, sheet wrinkling and maybe jams when used in high-speed copiers or printers.

SUMMARY OF THE INVENTION

It is, therefore, an object of the present invention to provide a sheet inverting mechanism that would operate efficiently at high speeds in high-speed copiers and printers without creating bottlenecks and sheet jams in its sheet containment, chamber.

In accordance with the present invention, a sheet inverting mechanism is provided and includes a sheet containment chamber and a drive shaft assembly having a drive shaft and means for rotating the drive shaft in a forward direction. The mechanism also includes a driven shaft assembly that has a driven shaft and a series of sheet moving rollers mounted on the driven shaft and on one side of the containment chamber. The sheet moving rollers form sheet moving nips with corresponding idler rollers that are mounted on an opposite side of the chamber.

For moving sheets at a high speed into and reversibly out of the chamber, the mechanism further includes first and second motion-transmission assemblies for selectively rotating the driven shaft assembly respectively in a first forward direction to move sheets forwardly within the chamber, and in a second and opposite direction to reversibly move sheets back out of the chamber. The first motion-transmission assembly is mounted couplably to a first end of the drive shaft and the second motion-transmission assembly is mounted couplably to the second and opposite end of the drive shaft. A switch is included for selecting either the first or the second motion-transmission assembly for moving a sheet within the chamber.

BRIEF DESCRIPTION OF THE DRAWINGS

In the detailed description of the invention presented below, reference is made to the drawings, in which.

DETAILED DESCRIPTION OF THE PREFERRED EMBODIMENT

Because electrostatographic reproduction apparatus are well known, the present description will be directed in particular to elements forming part of or cooperating more directly with the present invention. Apparatus not specifically shown or described herein are selectable from those known in the prior art.

Figure 1:
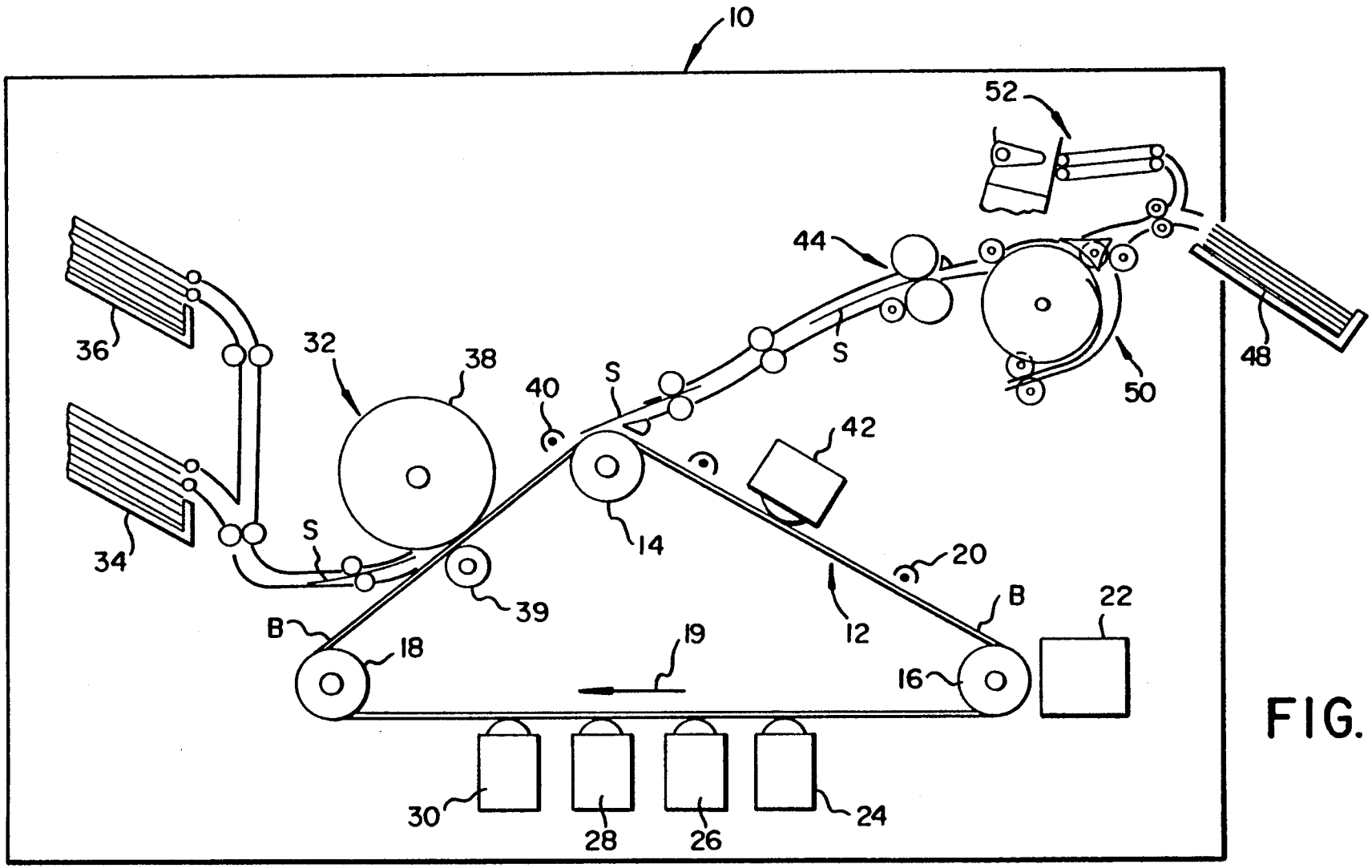
FIG. 1 is a schematic of an exemplary electrostatographic reproduction apparatus that incorporates the sheet inverting mechanism of the present invention.

Referring now to FIG. 1, a sheet-handling piece of equipment, such as an electrostatographic copier or printer, is shown generally as 10. The copier or printer 10, as shown, includes an image-bearing member 12 which can be, for example, an endless photoconductive web trained about a plurality of rollers 14, 16 and 18. One of such rollers can be a drive roller for moving the member 12 in the direction of the arrow 19. As is well known, the member 12 can also be a rotatable rigid drum.

The copier or printer 10 also includes a charging station 20 for placing a uniform layer of electrostatic charge on an image-bearing surface B of the member 12, and an imagewise exposure station 22, shown as an electronic printhead, which may employ LED's or a laser, etc. for creating an electrostatic image pattern in the laid down charge layer. Of course, such an image pattern may also be formed using optical means at an appropriate optical exposure station, or by an electrographic writer. The created image pattern is next developed with toner particles of one or more colors at one or more of the development stations therein, shown as 24, 26, 28, 30, and each containing toner particles of a different color. The developed image on the surface B is subsequently transferred, at a transfer station 32 onto a first side of a suitable receiver sheet S, such as plain paper or a transparency fed in registration from a supply tray 34 or 36 thereof. As shown, the transfer station 32 may include a charged transfer drum 38, and a backup roller 39. The transfer drum 38 supports the receiver sheet S thereon for accepting one or a plurality of images.

Following transfer of one or more of the toner images to the first side of the sheet S, the sheet S is then separated from the surface B, for example, with the help of a detack corona 40. The surface B is subsequently cleaned at a cleaning station 42 in preparation for reuse similarly in forming and transferring another toner image.

Meanwhile, the sheet S, after such separation, is transported for example by rollers and guides as shown, to and through a fusing station 44. As is well known, the toner image on the first side of the receiver sheet S is heated at the fusing station 44 and fused onto such first side. The sheet S with the fused toner image on such first side thereof can thereafter be transported directly to a finished copy sheet output tray shown as 48.

Alternatively, the sheet S with the fused toner image on such first side thereof, may be inverted by means of the sheet inverter mechanism of the present invention, shown generally as 50, for reuse within the copier or printer for example for duplex imaging. As is well known, for such duplex imaging, two sequential "complete" toner images, for transfer to the first and second sides of the sheet S, are formed on the surface B. Each of these "complete" toner images may be comprised of plural color toner images that taken together form a "complete" toner image of the original. The first of the two "complete" images is first transferred, as above, to the first side of sheet S for fusing thereonto as described above. By means of an inverter mechanism such as 50, the sheet S is then inverted and returned, for example, by means shown partially as 52, to the transfer station 32, to receive the second of the two toner images onto the second side of such sheet S. Inversion of the sheet S therefore requires a reversion of the lead and trail edge orientation thereof, and hence of the front-and-back face orientation of the sheet S as viewed relative to the image-bearing surface B. The second side of the sheet S after receiving the second "complete" toner image thereon is thereafter similarly separated from the surface B for fusing at the fusing station 44. The sheet S can then be transported to the output tray 48.

Figure 2:
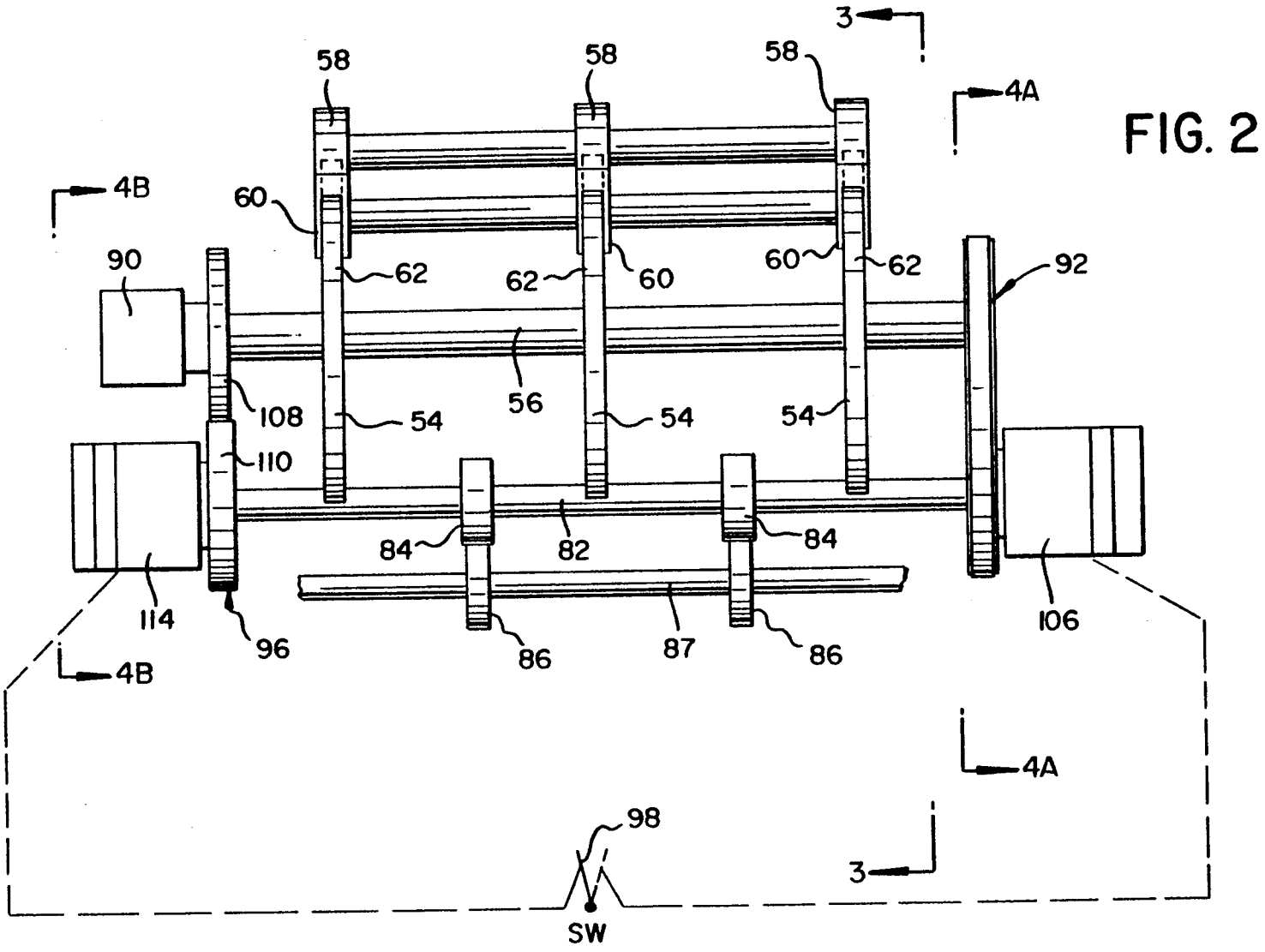
FIG. 2 is a top view of the roller and shaft assemblies of the sheet inverting mechanism of the present invention.
Figure 3:
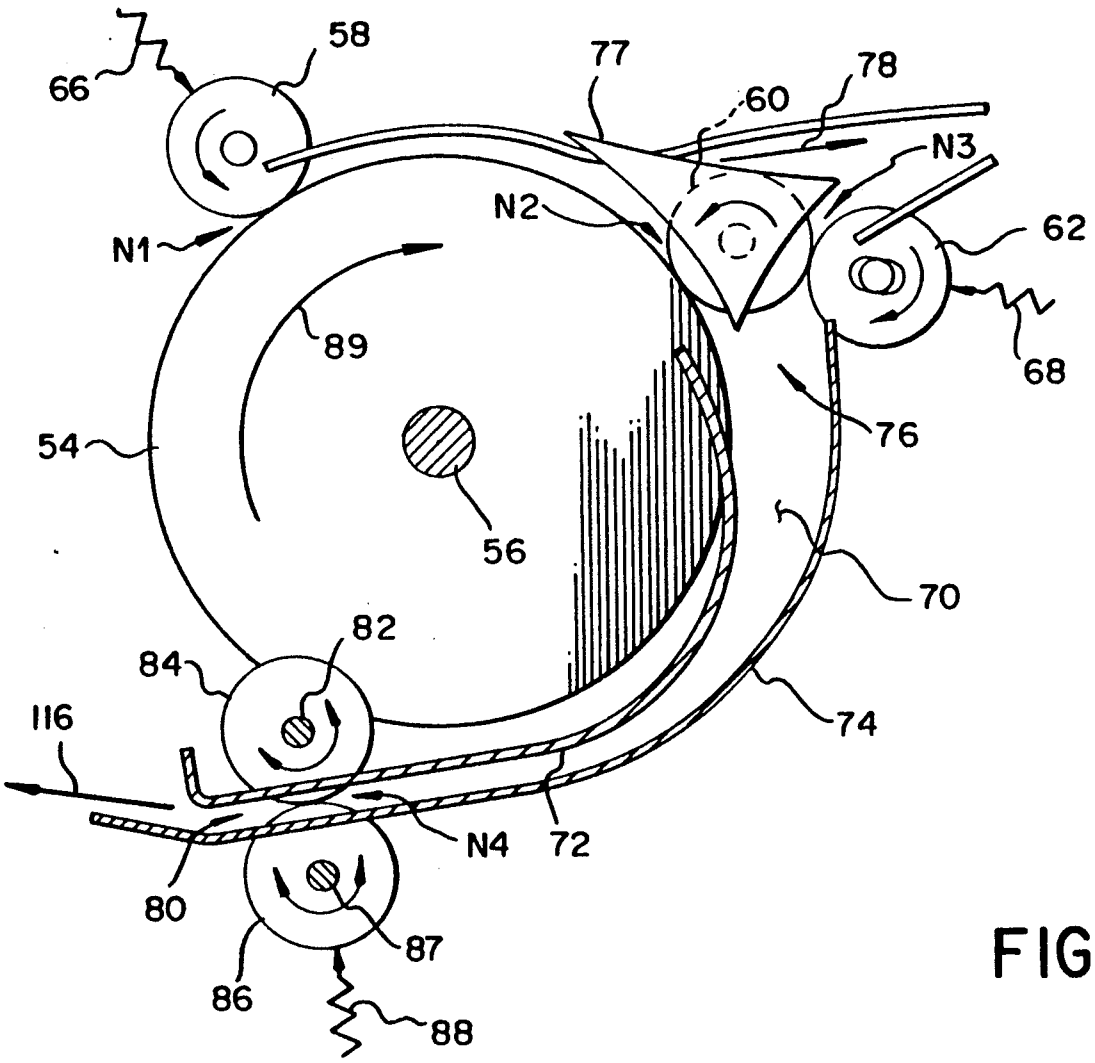
FIG. 3 is an enlarged side view, partly in section, of the sheet inverting mechanism of the present invention.

Referring now to FIGS. 2–4B, the sheet inverting mechanism 50 includes a series of large sheet input rollers 54 which are mounted fixedly along a drive shaft 56 for forming sheet input nips $N_1$, $N_2$, respectively, with corresponding series of nip-forming rollers 58 and 60. Another series of corresponding rollers 62 form sheet output nips $N_3$ with the series of rollers 60 as shown. As shown in FIG. 3, the series of rollers 58 are constantly urged by spring 66 into frictional driving engagement with the large sheet input rollers 54, and the series of rollers 62 are similarly urged by springs 68 into frictional driving engagement with the series of rollers 60.

As further shown in FIG. 3, the sheet inverting mechanism 50 includes a sheet confinement chamber 70 that is defined by first and second side guide members 72 and 74, respectively. The chamber 70 has a first end 76 where the rollers 60 form the sheet input nips $N_2$ with the rollers 54, and the rollers 62 form the sheet output nips $N_3$ with the rollers 60. A sheet diverter 77 is mounted, for example, coaxially with the series of rollers 60 for selectively closing off sheet entrance into the input nips $N_2$ thereby diverting a sheet fed from input nips $N_1$ such that the sheet follows a bypass path shown by an arrow 78, bypassing the chamber 70. The chamber 70 also has a second and opposite end shown as 80 that is open in order to enable sheets of varying lengths or intrack dimensions to be handled effectively by the mechanism 50, as well as to allow sheets to be fed out of the chamber 70 through such second end 80.

For moving sheets at a relatively high speed through the sheet inverting mechanism 50, the mechanism 50 includes a driven shaft assembly that has a driven shaft 82 and a series of sheet moving rollers 84 which are mounted fixedly along the driven shaft 82 for rotation therewith, and on the first side (guide 72) of the chamber 70. As shown, the sheet moving rollers 84 form sheet moving nips $N_4$ with a series of corresponding idler rollers 86 that are mounted fixedly along a shaft 87 for rotation therewith on the second side (guide 74) of the chamber 70. The shafts 82 and 87, and the series of rollers 84 and 86 mounted respectively thereon, are reversibly rotatable as shown (FIG. 3), and the rollers 86 are constantly urged by springs 88 into the corresponding rollers 84 to form the sheet moving nips $N_4$.

Figure 4B:
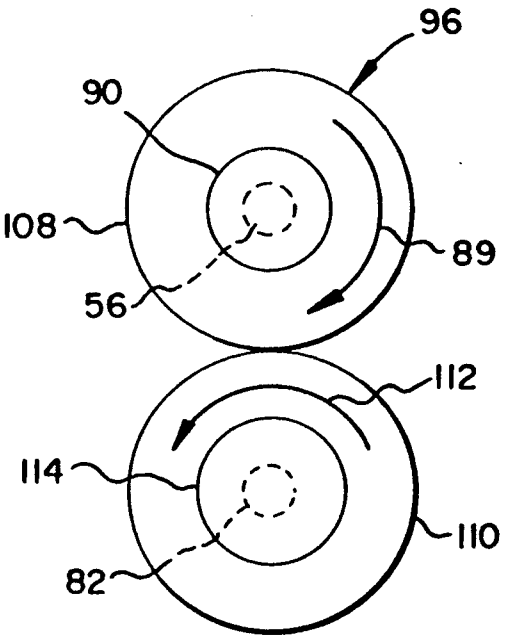
FIGS. 4A and 4B are views of the first and second motion-transmission assemblies of the present invention taken along cutting planes B—B and C—C, respectively of FIG. 2.
Figure 4A:
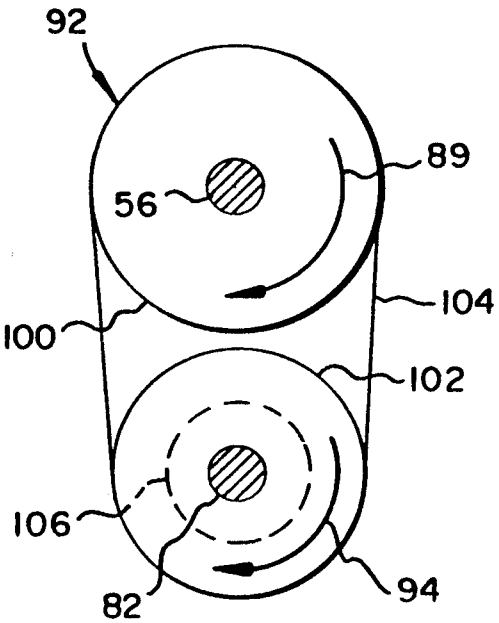

Referring particularly to FIGS. 2 and 4A, 4B, the sheet inverting mechanism 50 includes a drive means such as a motor 90 for rotating the drive shaft 56 in a forward direction as shown by the arrow 89. The mechanism 50 also includes a first motion-transmission assembly shown generally as 92 that is associated with a first end of the drive shaft 56 for selectively transmitting forward rotation of the drive shaft 56 to the driven shaft 82 of the driven shaft assembly, and hence to the series of rollers 84. Because the $N_4$ nip forming rollers 86 are in frictional driving engagement with the rollers 84, the forward rotation of the drive shaft 56 is therefore also transmitted forwardly to the rollers 86. The first motion-transmission assembly 92 as shown is mounted for rotating the driven shaft 82 and hence the rollers 84 in a first forward direction shown by the arrow 94 in order to move a sheet forwardly from the first end 76 towards the second end 80 of the chamber 70.

The mechanism 50 further includes a second motion-transmission assembly shown generally as 96 that is associated with the opposite, second end of the drive shaft 56 for selectively transmitting the forward rotation of the drive shaft 56 reversibly to the driven shaft 82 and hence to rollers 84 of the driven shaft assembly. The second motion-transmission assembly 96 is mounted couplably to, and for rotating the driven shaft 82 and its rollers 84 in a second reverse direction, that is, a direction opposite to that of the first motion-transmission assembly 92, in order to move sheets reversibly in the nips $N_4$ back towards the sheet output nips $N_3$.

Further, according to the present invention, a toggle switch 98 is provided for selectively energizing either the first or second motion-transmission assemblies 92, 96, respectively, for transmitting their respective motions to the driven shaft 82, thereby moving a sheet within the chamber 70 either in a forward or reverse direction. As shown, the switch 98 is connected to a power source (not shown) and to the motion-transmission assemblies 92, 96 such that switch selection of one, automatically deselects the other.

Referring again to FIGS. 2 and 4A, the first motion-transmission assembly 92 is shown and includes a first pulley 100 that is mounted fixedly to the first end of the drive shaft 56 for rotation therewith in the forward direction shown by the arrow 89. The assembly 92 also includes a second pulley 102 that is mounted couplably to, and for rotation with the driven shaft 82. The assembly 92 further includes a drive belt 104 that is mounted onto the first and second pulleys 100, 102 for transmitting the motion of the first pulley 100 in the forward direction of the arrow 89 directly and forwardly to the second pulley 102, thereby also causing rotation or motion of the second pulley in the direction of the arrow 94 which is the same as that of the arrow 89. More importantly, the first motion-transmission assembly 92 includes a first one-way clutch, such as a one-way spring wrap clutch assembly 106 (FIGS. 2 and 4A) that is connected to the switch 98, and is mounted to the second pulley 102 for selectively coupling rotation of the second pulley 102 to the driven shaft 82.

Referring to FIGS. 2 and 4B, the second motion-transmission assembly 96 is shown and includes a first gear 108 that is mounted fixedly to the second end of the drive shaft 56 for rotation therewith in the forward direction of the arrow 89. The assembly 96 also includes a second gear 110 that is mounted couplably to, and for rotation with the driven shaft 82. As mounted, the second gear 110 externally meshes with the first gear 108, and hence is rotated by the first gear 108 in a direction shown by the arrows 112 which is opposite to the forward direction of rotation of the first gear 108. The second motion-transmission assembly 96 further includes a second one-way clutch assembly 114, for example a one-way spring wrap clutch, that is connected to the switch 98, and is mounted to the second gear 110 for selectively coupling the rotation of the second gear 110 to the driven shaft 82.

Referring now to FIGS. 2–4B, for moving a sheet forwardly into the sheet inverting mechanism 50, the motor 90 is turned on to continuously rotate the drive shaft 56 in the forward direction of the arrow 89. The large sheet moving rollers 54 are thus rotated in the same direction and frictionally drive the rollers 58 and 60 directly, and the rollers 62 indirectly through the rollers 60. The switch 98 is controlled to select the first motion-transmission assembly 92 (which includes the belt driven pulleys 100, 102) thereby automatically deselecting the assembly 96. With the first pulley 100 rotating with the large rollers 54 on the drive shaft 56, and with the rotating second pulley 102 coupled by such selection to the driven shaft 82, the sheet moving rollers 84 will be rotated in the same direction (clockwise FIGS. 3 and 4A) as the large rollers 54. A sheet fed into the chamber 70 through the nips $N_1$ and $N_2$ eventually therefore will be picked up by the rollers 84 in the nips $N_4$ for forward feeding in the direction of the arrow 116.

If desired, a sheet fed forwardly, as such, into the nips $N_4$ can be fed completely and uninverted through the nips $N_4$ out of the chamber 70 through the end 80 for example to a collection tray (not shown). Typically, however, a sheet fed into the nips $N_4$ as above has to be reversibly fed back towards the first end 76 of the chamber 70 for outputting through the output nips $N_3$ in a reversed and inverted orientation. The open ended design of the second end 80 of the chamber 70 allows sheets of various lengths or intrack dimensions to be reversed efficiently and effectively within the chamber 70.

For reversing a sheet within the nips $N_4$ for feeding back into the nips $N_3$, conventional means (not shown) are provided for throwing the switch 98 from the first motion-transmission assembly 92 to the second such assembly 96 thereby coupling the rotating second gear 110 to the driven shaft 82. Since the drive shaft 56 and the motion-transmission assemblies 92, 96 are continuously rotating in the appropriate directions as above during selection periods and deselection periods, and are therefore always ready to be coupled or uncoupled from the driven shaft 82, the only inertia to be overcome at the moment of coupling is that of the driven shaft 82 and its rollers 84 which are in fricitonal contact with a sheet in the nips $N_4$. As such, coupling the rotating gear 110 with the inertia of the drive shaft behind it to the driven shaft 82 quickly and efficiently causes reversible movement of the shaft 82 and of a sheet in the nips $N_4$.

According to the present invention, as soon as, or even before, a sheet within the nips $N_4$ begins such reverse motion, another sheet can be in the process of being fed into the chamber 70 through the nips $N_1$ and $N_2$. In fact, it has been found that such two-direction moving sheets can overlap as much as about six inches (6 in.) of their eight and one-half inches (8½ in.) intrack dimension within the chamber 70. This is because the switch 98 can be thrown to the sheet forward feeding assembly 92 as soon as the trail edge of a reverse moving sheet leaves the nips $N_4$.

Figure 5:
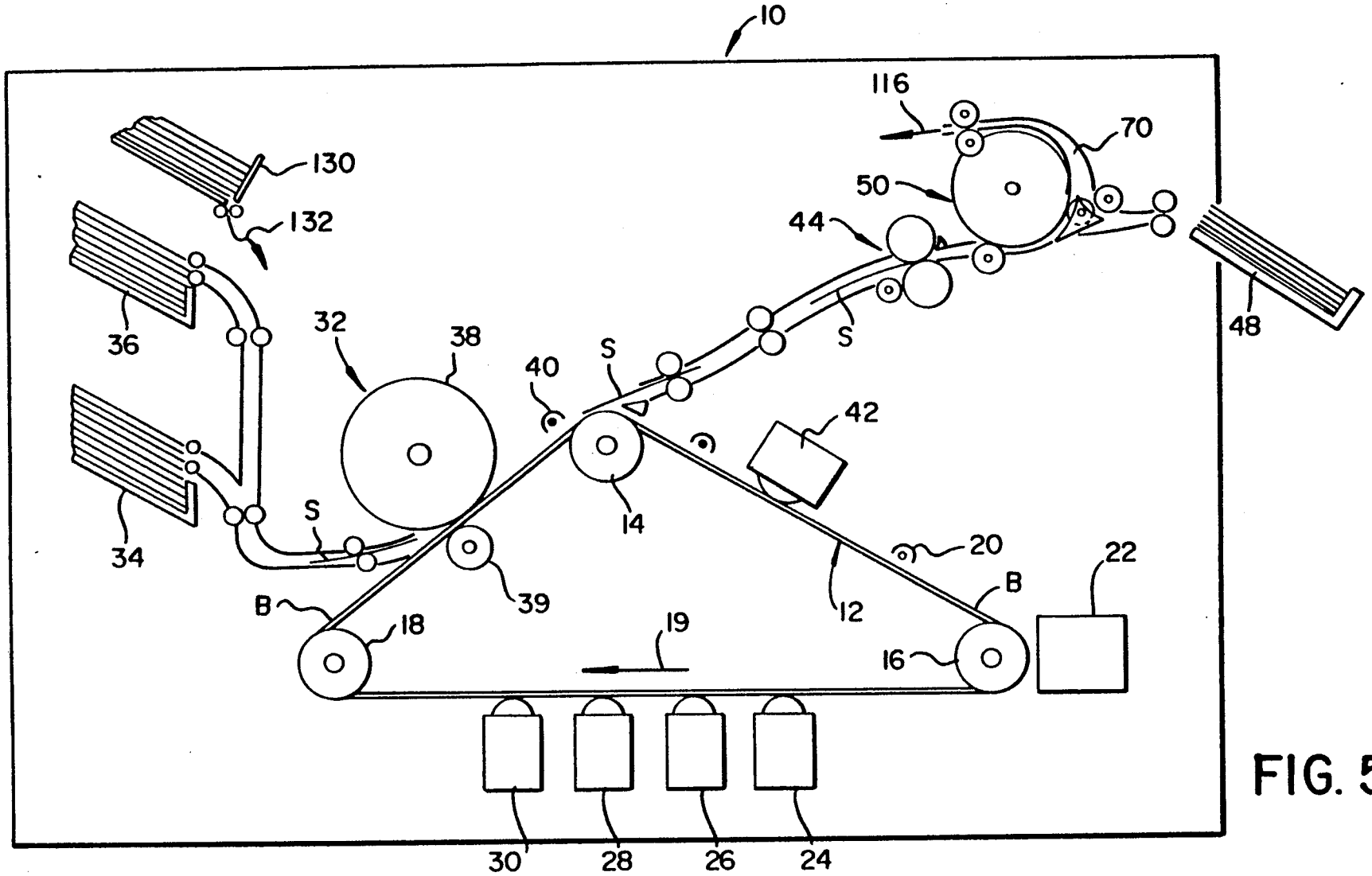
FIG. 5 is similar to FIG. 1 but showing the sheet inverting mechanism of the present invention in an upside down arrangement.

Referring now to FIG. 5, a schematic of an exemplary reproduction apparatus is shown generally as 10, and in most respects is similar to that of FIG. 1, except that it includes the sheet inverting mechanism 50 of the present invention, in an upside down arrangement. This is opposite to a conventional right-side-up arrangement for sheet inverting mechanisms as disclosed in the cited prior art, for example.

In a reproduction apparatus as shown for example in FIG. 1 that includes a conventional right-side-up inverting mechanism, an inverted sheet handling assembly, e.g. 52 (FIG. 1) must be provided for returning the inverted sheet through a path above the fusing apparatus to a duplex tray 130. From the duplex tray 130, the inverted sheet is then refed along the arrow 132 by means not shown to the image transfer station to receive a second image on a second side thereof.

Advantageously, including the open-bottom sheet inverting mechanism 50 of the present invention (FIGS. 2 and 3) in an upside down arrangement eliminates the need for a dedicated mechanism 52 since the chamber 70 with its open bottom 80 then serve to feed sheets through the chamber to a duplex tray 130. More importantly, the inversion of sheets in a duplex operation is greatly implied since movement of each sheet to the duplex tray (as shown by the arrow 116) need not be reversed as in conventionally arranged inverters. The efficiency of the inversion method of the upside down inverter arrangement is significantly high.

As mounted upside down, the mechanism 50 can also be used to invert sheets being sent to the output tray 48 such that the bottom surface of each such sheet as coming from the fusing apparatus 44 becomes the top surface in the tray 48.

As can be seen, a sheet inverting mechanism 50 has been provided that has a sheet containment chamber 70 with an open second end enabling it to feed sheets through the chamber or to reversibly handle sheets of various intrack dimensions. More particularly, the mechanism 50 includes first and second motion-transmission assemblies including a belt and pulley drive assembly and a meshing gear drive assembly respectively for quickly and effectively moving sheets within the chamber first in one direction and then in a second and reverse direction, thereby allowing for a high-speed operation.

The invention has been described in detail with particular reference to preferred embodiments thereof, but it will be understood that variations and modifications can be effected within the spirit and scope of the invention.

What is claimed is:

1. A high-speed sheet inverting mechanism for use in a high-speed sheet copier or printer, the sheet inverting mechanism comprising:

(a) a sheet-containment chamber;

(b) a drive shaft assembly including a drive shaft and means for rotating said drive shaft in a forward direction for feeding a sheet into said chamber;

(c) a driven shaft assembly including a driven shaft and a series of sheet moving rollers mounted on said driven shaft for rotation therewith, and on one side of said chamber, said sheet moving rollers forming sheet moving nips with corresponding idler rollers mounted on an opposite side of said chamber;

(d) a first motion-transmission means associated with a first end of said drive shaft for selectively transmitting rotation of said drive shaft to said driven shaft assembly to rotate said driven shaft assembly in a first forward direction for moving sheets forwardly within said chamber;

(e) a second motion-transmission means associated with a second and opposite end of said drive shaft for selectively transmitting said rotation of said drive shaft to said driven shaft assembly to rotate said driven shaft assembly in a second and opposite direction for moving sheets reversibly out of said chamber; and (f) switch means for selecting either said first or said second motion-transmission means for moving a sheet within said chamber.

2. The sheet inverting mechanism of claim 1 wherein said corresponding idler rollers are constantly spring urged into nip contact with said sheet moving rollers.

3. The sheet inverting mechanism of claim 1 wherein said first motion-transmission means comprises:

(a) a first pulley mounted fixedly on said first end of said drive shaft for rotation therewith in said forward direction;

(b) a second pulley for rotation with said driven shaft in said forward direction of said drive shaft, said second pulley being couplable to said driven shaft assembly;

(c) a drive belt mounted onto said first and second pulleys for transmitting rotation of said first pulley in said forward direction to cause rotation of said second pulley in said same forward direction of said drive shaft; and (d) a first clutch assembly connected to said switch means and mounted on said second pulley for selectively coupling rotation of said second pulley to said driven shaft assembly.

4. The sheet inverting mechanism of claim 1 wherein said second motion-transmission means comprises:

(a) a first gear mounted fixedly on said second end of said drive shaft for rotation therewith in said forward direction;

(b) a second gear externally meshing with said first gear for rotation in a direction opposite to said forward direction of said drive shaft, said second gear being couplable to said driven shaft assembly for rotating said driven shaft assembly in said direction opposite to said forward direction of said drive shaft; and (c) a second clutch assembly connected to said switch means and mounted on said second gear for selectively coupling rotation of said second gear to said driven shaft assembly.

5. The sheet inverting mechanism of claim 1 wherein selection of one of said first and second motion-transmission means automatically deselects the other.

6. The sheet inverting mechanism of claim 1 wherein said first and second motion-transmission means for selectively transmitting rotation of said drive shaft to said driven shaft assembly rotate continuously in their respective directions during periods of selection and during periods of de-selection.

7. The sheet inverting mechanism of claim 1 wherein said sheet containment chamber includes a first end, and an open and opposite second end beyond said sheet moving and idler rollers for forwardly moving sheets therethrough from said sheet moving and idler rollers.

8. The sheet inverting mechanism of claim 3 wherein said first clutch assembly includes a one-way spring-wrap clutch.

9. The sheet inverting mechanism of claim 4 wherein said second clutch assembly includes a one-way spring-wrap clutch.

10. The sheet inverting mechanism of claim 7 including sheet infeed and sheet output rollers at said first end of said chamber capable of simultaneously infeeding a sheet into and outputting another sheet from said chamber, and wherein said driven shaft assembly is decouplable from said second motion-transmission means and recouplable to said first motion-transmission means as soon as a trailing edge of a reversed outfeeding sheet leaves said sheet moving nips, thereby enabling the high-speed simultaneous handling of two sheets moving in two opposite directions within said chamber.

* * * * *